United States Patent [19]

Schreckenberg

[11] 3,986,432

[45] Oct. 19, 1976

[54] AMMUNITION MAGAZINE

[75] Inventor: Klaus Schreckenberg, Kassel, Germany

[73] Assignee: Rheinstahl AG, Essen, am Rheinstahlhaus, Germany

[22] Filed: Sept. 30, 1974

[21] Appl. No.: 510,562

[30] Foreign Application Priority Data

Oct. 1, 1973 Germany ..... 2349185

[52] U.S. Cl. ..... 89/45; 89/36 K

[51] Int. Cl.[2] ..... F41F 9/06

[58] Field of Search ..... 89/33 A, 33 B, 36 K, 89/45, 46, 47

[56] References Cited

UNITED STATES PATENTS

| | | | |
|---|---|---|---|
| 2,905,056 | 9/1959 | Nectoux | 89/45 |
| 3,598,016 | 8/1971 | Chiabrandy et al. | 89/47 |
| 3,763,741 | 10/1973 | Rieke | 89/47 |

*Primary Examiner*—Stephen C. Bentley
*Attorney, Agent, or Firm*—Walter Becker

[57] ABSTRACT

An ammunition magazine with a feeding device in the form of two pivotal arms for a weapon which is laterally adjustable and adjustable as to height. The magazine comprises two sections symmetrically connected to the weapon from which the feeding device grasps ammunition and moves the same to a charging position in which the ammunition is aligned with the bore of the barrel. Each of the two magazine sections has associated therewith one of the two pivotal arms which by power-operable means are so actuated that while either one moves ammunition from one ammunition magazine section into alignment with the barrel, the respective other pivotal arm moves to the respective pertaining magazine section for picking up ammunition.

5 Claims, 3 Drawing Figures

AMMUNITION MAGAZINE

The present invention relates to an ammunition magazine chamber with follower for a weapon which is adjustable laterally and as to height, said magazine chamber comprising two sections symmetrically connected to the weapon. The arrangement is such that the follower which feeds the ammunition into loading position takes part in the adjusting or aiming movements.

With a heretofore known weapon loading device, especially for weapons mounted on vehicles, the ammunition which is located in the magazine chamber parallely with regard to the axis of the bore of the weapon is by means of a charger which is pivotable in a vertical plane of the axis of the bore of the weapon conveyed from the mechanism chamber below the weapon upwardly to a position which is in alignment with the axis of the bore of the weapon. The ammunition is then by means of a device independent of the lifting device moved in longitudinal direction and pushed into the barrel of the weapon. With a device of this type which is described in German Pat. No. 1428711, the magazine chamber consists of circular curved ammunition compartments arranged concentrically with regard to the axis of the bore of the weapon whereby a great overall size projecting beyond the vehicle is obtained. Furthermore, for the upward movement of the ammunition from the magazine chamber to the loading position, only one charger is employed whereupon the transport becomes timeconsuming and consequently the firing speed is not always sufficient.

In order to overcome this drawback, an ammunition magazine has been suggested with a plurality of vertical cartridge receiving compartments and a cartridge feeding table therebelow, according to which the cartridges are by followers movable back and forth on the feeding table moved laterally and intermittently toward the weapon. Such a device is disclosed in German Pat. No. 1072517. This arrangement has the drawback that the device is feasible only for a limited angle of elevation of the weapon, and the cartridges are on the feeding table stepwise moved toward the weapon in different directions, namely partially vertically to the longitudinal axis of the weapon and partially transverse thereto.

It is, therefore, an object of the present invention so to design the ammunition magazine chamber with a feeding device of the above mentioned type that the ammunition magazine chamber will have an overall low height and will be independently of the angular positions of the weapon and will assure a fast ammunition transport so that a high firing cadence will be assured.

These and other objects and advantages of the invention will appear more clearly from the following specification in connection with the accompanying drawings, in which:

FIG. 1 diagrammatically shows in longitudinal section an ammunition magazine chamber with a feeding device in loading position.

Figure 1:
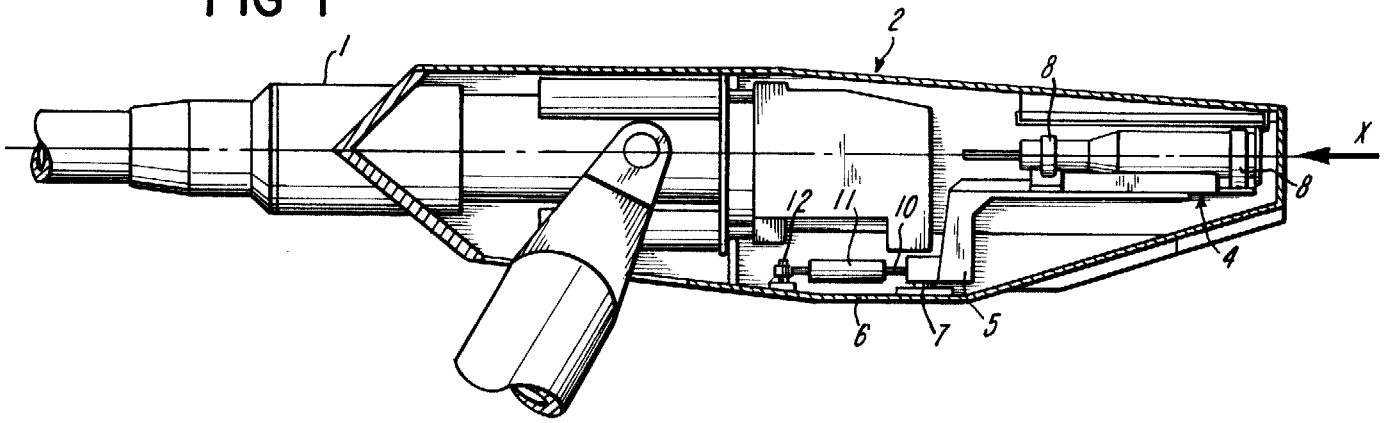

The ammunition magazine according to the present invention is characterized primarily in that it is arranged substantially horizontally and for the ammunition which, with its longitudinal axis is arranged perpendicularly with regard to the axis of the bore of the weapon, is flat while each magazine section laterally of the weapon comprises a feeding device which includes a pivotable arm with holding jaws which arm is mounted on the magazine housing, both feeding devices being pivotable laterally and in opposite direction to each other and primarily in an alternating manner.

An important advantage of this design is seen in the fact that the ammunition transport from the magazine to the loading position is effected in one plane which means without differences in height and also is effected in one direction. However, it is also possible to carry out the movement of the two pivot arms simultaneously in opposite directions.

According to a further development of the invention, each pivotable arm is linked to a pivot arranged on the magazine bottom and connected to a piston rod of a hydraulic cylinder piston system which is pivotally journaled on a pivot likewise connected to a magazine bottom.

A further advantage of the invention consists in that the holding jaws which are provided on the pivot arm are designed in the manner of pliers and so embrace the ammunition that the latter will be secured also against longitudinal movements.

Referring now to the drawings in detail, the drawings show an ammunition magazine 2 which is connected to a weapon 1 that is laterally adjustable and also adjustable as to height. This ammunition magazine 2 comprises two symmetrically arranged sections 3,3' while each section comprises a charger or feeding device 4,4'. The two magazine sections 3,3' are laterally arranged which means at the right and at the left from the axis of the bore of the weapon, and while being substantially horizontally arranged on said weapon have a flat shape. The ammunition is mounted in the magazine in such a way that its longitudinal axis is vertical to the axis of the bore of the weapon. Each charger or feeding device 4,4' comprises primarily a pivotable arm 5,5' which is cranked and is linked to a pivot 7,7' provided adjacent the weapon 1 at the bottom 6 of the magazine housing. Each feeding device 4,4' comprises holding jaws 8,9 for grasping ammunition, e.g. a cartridge *c* from the respective magazine chamber section and transporting the same to the charging position in axial alignment with the bore of the barrel. The jaws 8,9 may be formed by curved clamp-shaped resilient spring -steel arms adapted to spread when pushed against the cartridge and then to spring back to holding position. A hydraulically operable device is provided for the lateral pivoting movements. In this connection it should be noted that the pivot arm 5,5' is connected to a piston rod 10,10' of a hydraulic cylinder-piston system 11,11' which latter is pivotally journalled on a pivot 12,12' which is likewise connected to the magazine bottom 6. The holding jaws are adapted to the cross sectional form of the ammunition and simultaneously prevent an accidental movement of the ammunition in the longitudinal direction thereof.

Figure 2:
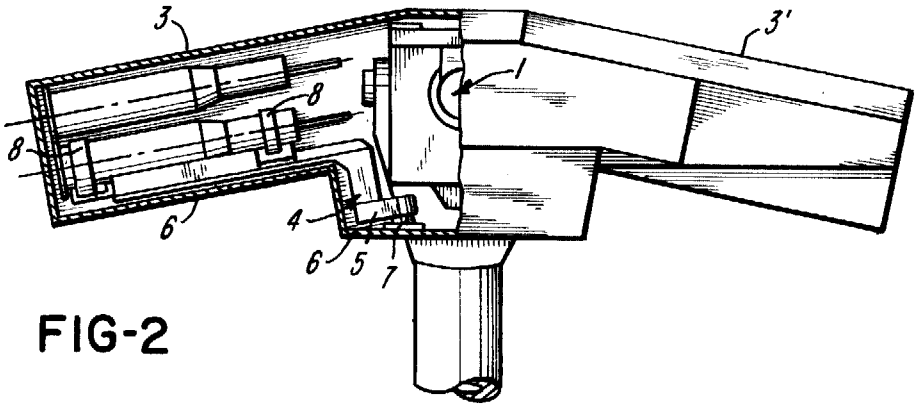
FIG. 2 is a view of FIG. 1 as seen in the direction of the arrow X while a portion of the rear wall of said ammunition magazine chamber is broken out showing the feeding device in feeding position.
Figure 3:
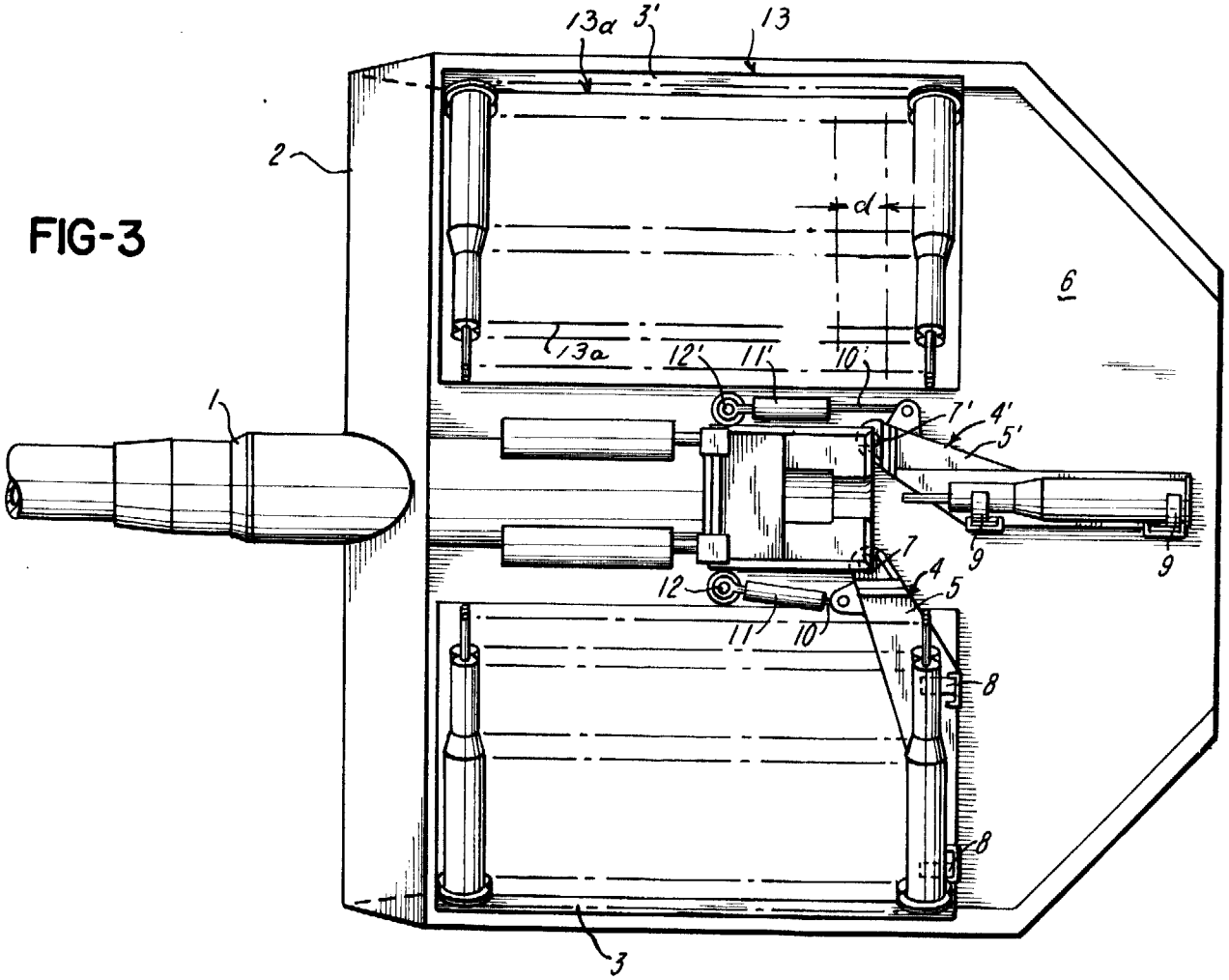
FIG. 3 is a top view of the device of FIG. 1 while the ceiling of the ammunition magazine chamber has been omitted.

The cartridges *c* are carried by a chain belt 13 diagrammatically indicated by straight lines 13*a* only which carried the cartridges in two planes one above the other as best shown on the left hand side of FIG. 2. The chain belts of the two magazine sections are alternately advanced by the distance *d*, i.e. by one cartridge, so that one cartridge at a time of each magazine section moves from its upper plane to its lower plane to the position where the respective cartridge is grasped by the jaws 8,9 of the pertaining feeding device 4.4'. Any suitable standard device (not shown) may be used within a set time alternately to advance the respective chain belt by the distance *d* for the alternating pick-up of one cartridge by the pertaining charger or feeder 4,4'. With the feeding devices alternately pivoting into charging position and pick-up position in synchronisme with the alternating movement and stopping of the chain belts carrying the cartridges, always one device 4,4' occupies its pick-up position whereas the other device is in its charging position as shown in FIG. 3. After the charging operation has been completed, the feeding device last occupying its charging position pivots back to its pick-up position so that after firing the ammunition, the sleeve or the like thereof can be ejected unimpededly.

It is, of course, to be understood that the present invention is, by no means, limited to the specific showing in the drawings, but also comprises any modifications within the scope of the appended claims.

What I claim is:

1. In combination with a weapon having a barrel and being adjustable laterally and as to height and having follower means for moving ammunition to a charging position for charging the ammunition into said barrel, an ammunition magazine having a first and second section, said sections being symmetrically connected to said weapon on opposite sides of said barrel, said first and second sections and said follower means being movable together with said weapon during said lateral adjusting movement and the adjusting movement as to height of said weapon, said first and second magazine sections defining flat ammunition chambers for receiving and supporting ammunition with the longitudinal axis thereof defining with said barrel axis a substantially right angle, said follower means including pivotable arm means with resilient jaw means for grasping ammunition from said sections and supporting the said grasped ammunition, and power-operable means operatively connected to said pivotable arm means and operable to shift the latter to a position so as to axially align ammunition carried thereby with said barrel, said magazine including a bottom and first and second pivot means respectively arranged in said bottom, said first pivot means having said pivotal arm means pivotally connected thereto, and also including hydraulic cylinder-piston means pivotally connected to said second pivot means and operatively connected to said pivotal arm means.

2. An arrangement according to claim 1, in which each of said two magazine sections has a pivotal arm means associated therewith, the thus provided two arm means being movable relative to each other so that one pivotable arm means moves into charging position while the other one of said pivotal arm means returns to the respective pertaining one of said two ammunition sections.

3. An arrangement according to claim 1, in which said jaw means include resilient leaf spring means for grasping ammunition from the respective ammunition section and supporting same.

4. An arrangement according to claim 2, in which said pivotal arm means are pivotally connected to the portion of the pertaining magazine section.

5. An arrangement according to claim 1, in which said jaw means are designed in the manner of a plier and are operable so to grasp the ammunition as to secure the same against accidental longitudinal movement.

* * * * *